US010839777B1

(12) United States Patent
Hope

(10) Patent No.: US 10,839,777 B1
(45) Date of Patent: Nov. 17, 2020

(54) HUMIDIFIER

(71) Applicant: Stephen Charles Hope, Bel Air, MD (US)

(72) Inventor: Stephen Charles Hope, Bel Air, MD (US)

( * ) Notice: Subject to any disclaimer, the term of this patent is extended or adjusted under 35 U.S.C. 154(b) by 0 days.

(21) Appl. No.: 16/740,423

(22) Filed: Jan. 11, 2020

(51) Int. Cl.

| | |
|---|---|
| ***G10G 7/00*** | (2006.01) |
| ***G10C 9/00*** | (2019.01) |
| ***G10D 3/00*** | (2020.01) |
| *B65D 81/22* | (2006.01) |

(52) U.S. Cl.
CPC ..... *G10G 7/00* (2013.01); *G10C 9/00* (2013.01); *G10D 3/00* (2013.01); *B65D 81/22* (2013.01)

(58) Field of Classification Search
CPC ... G10G 7/00; G10C 9/00; G10D 3/00; B65D 81/22
See application file for complete search history.

(56) References Cited

U.S. PATENT DOCUMENTS

| | | | | |
|---|---|---|---|---|
| 3,407,700 | A | 10/1968 | Hollander | |
| 3,721,152 | A | 3/1973 | Von Meyer | |
| 4,428,892 | A | 1/1984 | Berliner | |
| 4,572,051 | A | 2/1986 | Laskin | |
| 4,649,793 | A | 3/1987 | Blackshear et al. | |
| 5,289,751 | A * | 3/1994 | Light | G10G 7/00 84/275 |
| 5,903,223 | A * | 5/1999 | Howell | F24F 6/10 261/104 |
| 5,936,178 | A | 10/1999 | Sarri | |
| 8,087,645 | B2 | 1/2012 | Hepple | |
| 8,220,782 | B2 | 7/2012 | Hepple | |
| 8,748,723 | B1 | 6/2014 | Egberg et al. | |
| 9,568,203 | B1 | 2/2017 | Small et al. | |
| 9,613,604 | B1 | 4/2017 | Shearer | |
| 10,121,460 | B1 | 11/2018 | Hepple | |

* cited by examiner

*Primary Examiner* — Kimberly R Lockett

(57) ABSTRACT

One embodiment of a humidifier designed to supplement humidity for the purpose of maintaining the moisture content of a wooden instrument such as a guitar. The humidifier comprises of an absorbent material, contained within an expandable outer shell, sealed at both ends. The shell is made from a non-permeable material but is constructed to be permeable. The humidifier is hydrated by submerging it in water, resulting in the absorption of liquid, causing expansion of the absorbent core and consequently expansion of the outer shell. Once hydrated, the outer shell is dried, and then, in the case of a hollow bodied instrument, is placed inside the body, or alternatively, and in the case of a solid bodied instrument, is placed in proximity to the instrument in a case or other enclosure. The shell allows the efficient egress of water vapor while isolating the instrument from liquid sequestered by the absorbent within.

14 Claims, 2 Drawing Sheets

HUMIDIFIER

BACKGROUND

Prior Art

The following is a tabulation of some prior art that presently appears relevant:

| U.S. Patents | | | |
|---|---|---|---|
| Pat. No. | Kind Code | Issue Date | Patentee |
| 3,407,700 | A | October 1968 | Hollander |
| 3,721,152 | A | March 1973 | Von Meyer |
| 4,428,892 | A | January 1984 | Berliner |
| 4,572,051 | A | February 1986 | Laskin |
| 4,649,793 | A | March 1987 | Blackshear et al |
| 5,289,751 | A | March 1994 | Light |
| 5,936,178 | A | October 1999 | Sarri |
| 8,087,645 | B2 | January 2012 | Hepple |
| 8,220,782 | B2 | July 2012 | Hepple |
| 8,748,723 | B1 | June 2014 | Egberg et al |
| 9,568,203 | B1 | February 2017 | Small et al |
| 9,613,604 | B1 | April 2017 | Shearer |
| 10,121,460 | B1 | November 2018 | Hepple |

Technical Field

This invention relates to musical instruments. More specifically, it relates to humidifying musical instruments.

BACKGROUND

Many musical instruments are made from wood. Wood is a naturally hygroscopic material, meaning it has the capacity to absorb water. It does so by equilibrating with the relative humidity of the local environment. Increased humidity causes wood to absorb, raising its moisture, causing it to swell. Similarly, decreased humidity causes wood to desorb, lowering its moisture content, causing it to contract. This can result in many adverse effects, such as bowing, warping, cupping and splitting of the wood. For musical instruments, in addition to structural issues, changes in moisture content can also affect playability as well as tone.

The moisture equilibration process for wood is slow, taking days to weeks, hence short-term changes in humidity have little effect. However, the effect of long-term, seasonal changes can be profound. For musical instruments, ideally the moisture content of the wood should be maintained at around 8%, equating to a humidity of around 50%. Hence, when the ambient humidity drops below that level for an extended period, humidity in proximity to the instrument should be supplemented. Typically, this would be achieved through the use of a humidifier.

For a musical instrument, ideally a humidifier would have the following features: It would be passive, meaning that there are no batteries, fans, heaters, etc.; it would have a high capacity for water allowing it to supplement humidity for multiple days between refills; it would be easily refillable; it would sequester liquid water in a wholly absorbed form, only releasing it through evaporation; it would have a large surface area that has a high porosity to water, hence allowing water to evaporate efficiently; it would not need to be attached to the instrument; it would have an outer shell that is soft and non-marring; it would have an outer shell that prevents direct contact of the absorbent with the instrument; it would be simple to manufacture in a variety of sizes and colors to suit a variety of instruments; it would be simple to use; and it would have a built-in, unmistakable indication of its state of hydration.

U.S. Pat. No. 3,407,700 by Hollander discloses a sponge housed in a flexible, impermeable, non-expandable tube, with a removable plug at one end and a fixed plug at the other. Water is soaked into the sponge and subsequently allowed to evaporate through a series of holes in the side of the tube. The present invention is simpler in its construction comprising of just two parts. It utilizes a super absorbent polymer which absorbs water wholly on a molecular scale. It has a capacity many times that of a sponge, and unlike a sponge, the application of force, typical with normal use, will not result in the release of water in liquid form. Moreover, through its ability to expand when hydrated and contract when desiccated, it provides an unmistakable indication of its current state of hydration.

U.S. Pat. No. 3,721,152 by Von Meyer, discloses a humidifier for an acoustic guitar that utilizes a porous foam material in a fixed cylindrical housing with holes at each end, suspended by a flexible element from a clip that is designed to mount to the edge of the sound hole of a guitar. The present invention is simpler in its construction comprising of just two parts. It utilizes a super absorbent polymer which absorbs water wholly on a molecular scale. It has a capacity many times that of porous foam, and unlike foam, the application of force, typical with normal use will not result in the release of water in liquid form. It does not need to be attached to the instrument. Moreover, through its ability expand when hydrated and contract when desiccated, it provides an unmistakable indication of its current state of hydration.

U.S. Pat. No. 4,428,892 by Berliner discloses a humidifier for musical instruments comprising of an enclosure with a capped water reservoir, and internal channels to route liquid water to peripheral absorbent ring. It is designed to be permanently attached to a surface such as the inner surface of a guitar case. The present invention is simpler comprising of just two parts, it requires no liquid reservoir, has a large capacity for water, cannot fail in manner that could release liquid into the body of the instrument or instrument case, and does not require available space within an instrument case for installation. Moreover, through its ability to expand when hydrated and contract when desiccated, it provides an unmistakable indication of its current state of hydration.

U.S. Pat. No. 4,572,051 by Laskin discloses a humidification device for stringed instruments comprising of sponge encapsulated in an open-ended vapor permeable bag. A sealing clip is used to close the open end, which also serves as a means of securing it between a pair of strings on an acoustic guitar. The present invention is simpler in its construction comprising of just two parts. It utilizes a super absorbent polymer which absorbs water wholly on a molecular scale. It has a capacity many times that of a sponge. It can be placed inside the body of any hollow bodied instrument with an opening, is not limited to stringed instruments, and does not need to be removed prior to playing the instrument. Moreover, through its ability to expand when hydrated and contract when desiccated, it provides an unmistakable indication of its current state of hydration.

U.S. Pat. No. 4,649,793 by Blackshear et al discloses a humidity modification device for an acoustic guitar comprising of a sound hole plug with a sponge-like absorbent material, contained within secondary housing attached to the surface of the sound hole plug that is exposed to inside of the instrument. The present invention is simpler in its construction comprising of just two parts. It utilizes a super absorbent polymer which absorbs water wholly on a molecular scale. It has a capacity many times that of a sponge, and unlike a sponge, the application of force, typical with normal use will not result in the release of water in liquid form. Moreover, through its ability to expand when hydrated and contract when desiccated, it provides an unmistakable indication of its current state of hydration.

U.S. Pat. No. 5,289,751 by Light discloses a humidifier comprising of a thin, rigid tube, housing an absorbent such as cellulose, which is designed to protrude into the body of a musical instrument through a custom hole in the sidewall of the instrument. The present invention is simpler in its construction comprising of just two parts. It utilizes an absorbent polymer with a capacity many times that of Light's design. It can be placed inside the body of any hollow bodied instrument with an opening and does not require the instrument to be modified with the addition of a custom hole. Moreover, through its ability to expand when hydrated and contract when desiccated, it provides an unmistakable indication of its current state of hydration.

U.S. Pat. No. 5,936,178 by Sarri, and U.S. Pat. No. 8,748,723 by Egberg et al, both disclose humidity control devices designed to regulate the humidity to a predetermined set point in sealed environment. Once desiccated, they cannot be readily refilled. In an airtight environment, they can maintain a specific humidity, however, if exposed to a low humidity environment for an extended period, they will desiccate quickly rendering them ineffective as humidifiers. The present invention is designed to supplement humidity in an unsealed environment as opposed to buffering humidity in sealed environment. It has a large capacity and can easily be refilled. Moreover, through its ability to expand when hydrated and contract when desiccated, it provides an unmistakable indication of its current state of hydration.

U.S. Pat. Nos. 8,087,645, 8,220,782, and 10,121,460 by Hepple disclose various embodiments of a humidifier comprising of container housing an absorbent, with a removable fill cap and a plate designed to mount the device to the strings of a stringed instrument such as a guitar. The present invention is simpler in its construction comprising of just two parts. It can be placed inside the body of any hollow bodied instrument with an opening, and is not limited to stringed instruments, Moreover, it does not need to be removed prior to playing the instrument.

U.S. Pat. No. 9,613,604 by Shearer, and U.S. Pat. No. 9,568,203 by Small et al both disclose embodiments of a humidifier comprising of an external liquid reservoir, feeding and absorbent element, coupled by flexible hose or tube. In both instances, the absorbent elements reside inside the instrument. The present invention is simpler comprising of just two parts. It requires no external reservoir, and cannot fail in manner that could release liquid into the body of the instrument. Moreover, it does not need to be removed prior to playing the instrument.

SUMMARY

In accordance with one embodiment, a humidifier comprises an absorbent material or a plurality of absorbent material, contained within a deformable, porous outer shell, sealed at both ends.

Advantages

Accordingly several advantages of one or more aspects are as follows: To provide a passive supplementary humidification source, that can be readily rehydrated, that has a non-marring outer shell, that when submerged has high porosity to the ingress of liquid water, that has a high porosity to the egress of water vapor, that has an expandable outer shell, that has an outer shell with a large surface area, that has an outer shell fabricated from a non-permeable material, that stores liquid water internally in an absorbed form, that releases water through the shell in a vapor form, that has a high capacity for water, that has an outer shell that prevents external contact with the absorbent housed within, that when hydrated is externally dry to the touch, that when hydrated provides a visual indication of its state of hydration, that does not need to be attached to the instrument, that can be placed inside the body of a hollow bodied instrument such as a guitar, that in the case of instruments with a hollow body such as a guitar, does not require removal prior to playing the instrument, that can be easily manufactured in color, that has a low cost of manufacture, that can be easily manufactured in various widths or lengths to suit a variety of applications. Other advantages of one or more aspects will be apparent from a consideration of the drawings and ensuing description.

DRAWINGS—FIGURES

In the drawings, closely related figures have the same number but different alphabetical suffixes.

DRAWINGS—REFERENCE NUMERALS

Figures 1A, 1B:
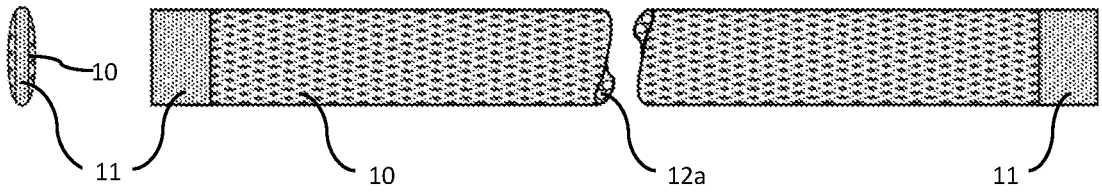
FIGS. 1A and 1B show various aspects of a humidifier in its desiccated state.

10 Outer shell of a humidifier
11 Sealed ends of the outer shell of a humidifier
12*a* Desiccated absorbent
12*b* Hydrated absorbent
13*a* A desiccated humidifier
13*b* A hydrated humidifier
14 An open container of water
15 A cloth
16 A hollow bodied instrument
17 The sound hole of a hollow bodied instrument

Detailed Description—FIGS. 1A and 1B—First Embodiment

One embodiment of a humidifier is illustrated in FIG. 1A (end view), and FIG. 1B (top view). The humidifier has a flexible woven outer shell 10 of a fiber such as polyethylene-tetra-phthalate (PET—hyphens are supplied to facilitate pronunciation), and of an expandable, tubular form, such as Flexo PET sleeving available from Techflex Inc. of Sparta, N.J. However, the shell can be made of any material that is flexible, that can be woven, formed, molded, 3D printed, or otherwise, into an expandable form, and that is non-permeable to liquid such as glass fiber, stainless-steel, brass, vinyl, polyethylene, polypropylene, rubber, and various metals, plastics or other plasticized materials.

The ends of the shell 11 are permanently sealed shut by means of fusion by heat. However, they may be sealed by other means such as welding, gluing, sewing, crimping, swaging, binding, capping, over-molding or otherwise.

Housed within the shell is an absorbent material consisting of a plurality of anionic polymer beads 12*a* such as sodium polyacrylate, available from JRM Chemical Inc. of Cleveland, Ohio However, the absorbent material may also be potassium polyacrylate, sponge, cellulose fiber, or any other material capable of absorbing liquid water, and releasing vapor.

Operation—FIGS. 1. To 6

Figure 3:
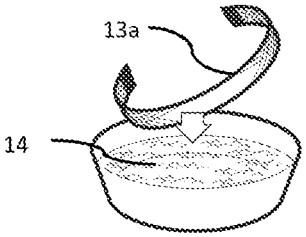
FIG. 3 shows a desiccated humidifier being placed into water.

To hydrate the humidifier, the desiccated humidifier 13*a* is submerged in water 14, as illustrated by FIG. 3. The water is preferably distilled, however, may be tap water or any other clean, non-salinized water. FIG. 1A (end view), and FIG. 1B (top view), illustrate a humidifier in its desiccated state.

Figures 2A, 2B:
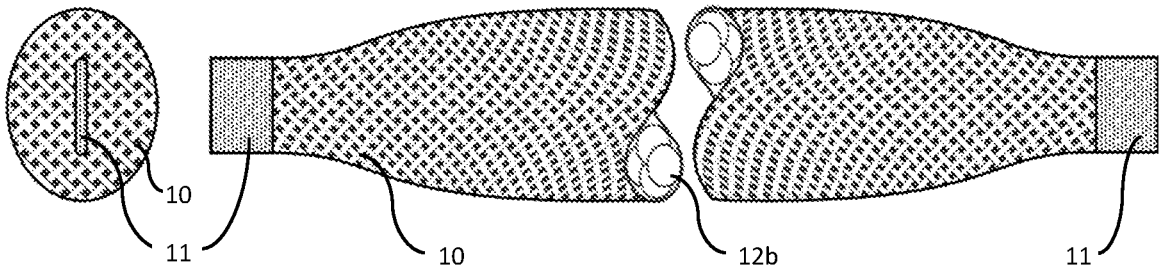
FIGS. 2A and 2B show various aspects of a humidifier in its hydrated state.

The absorbent material 12*a/b* contained within the outer shell 10 absorbs water causing it to swell. This in turn causes the shell to expand, significantly increasing the humidifier's volume. FIG. 2A (end view), and FIG. 2B (top view), illustrate the humidifier in its hydrated state.

Figure 4:
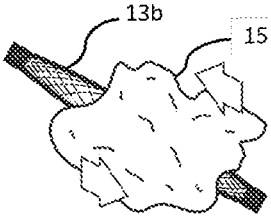
FIG. 4 shows the outer shell of a hydrated humidifier being dried with a cloth.

Once hydrated, the outside of the hydrated humidifier 13*b* is dried by means of a cloth 15, as illustrated by FIG. 4, or by other means such as a towel, paper towel, air drying, or otherwise.

Figure 5:
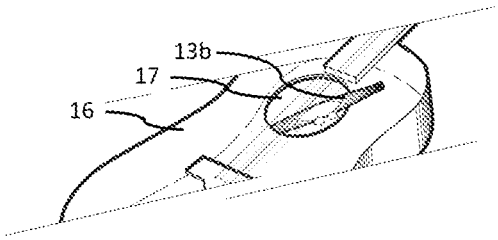
FIG. 5 shows a hydrated humidifier being placed into a guitar via the sound hole.

For a hollow bodied instrument 16, such as an acoustic guitar, the hydrated humidifier 13*b* is placed into the body of the instrument through the sound hole 17, as illustrated by FIG. 5. For solid bodied instruments, and alternatively for hollow bodied instruments, the humidifier may be placed in proximity to the instrument in an instrument case or other enclosure.

Over time, water evaporates from the absorbent core, augmenting humidity. This process of desorption causes the absorbent 12*a/b* and outer shell 10 to shrink, slowly returning the hydrated humidifier 13*b* to its original desiccated size. This change provides a built-in indication of remaining water content.

Figure 6:
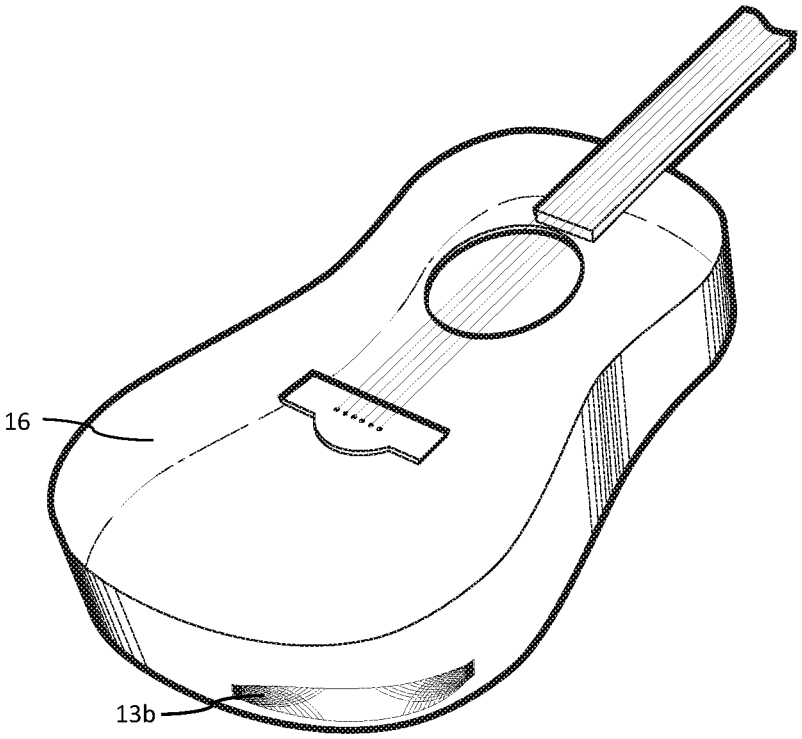
FIG. 6 shows a hydrated humidifier inside the body of a guitar, conforming to the guitars shape.

In the case of a hollow bodied instrument the hydrated humidifier 13*b*, which is soft and has a non-marring shell, will conform to the internal shape of the instrument 16, as illustrated by FIG. 6. This prevents excessive movement within the instrument, allowing it to be played with the humidifier in place.

Advantages

From the description above, a number of advantages of some embodiments of my humidifier become evident:

(a) It comprises of just two components and requires no special tooling to manufacture which means it is simpler and less expensive to fabricate than other products;
(b) It can be manufactured in variety of colors, patterns, and sizes without the need to change tooling or setups;
(c) It uses an absorbent polymer to store water. Water enters the absorbent in liquid form and is wholly absorbed, and can only egress as vapor, hence, once hydrated it cannot leak;
(d) It has an outer shell that is made from a non-permeable material, but designed to be highly porous, hence allowing water in the form of vapor to escape while providing physical barrier between the absorbent and the instrument.
(e) It is reusable and can be refilled at will simply by submerging it in water;
(f) It has a high capacity for water, allowing it to provide supplemental humidification for longer periods between refills;
(g) It has a larger active surface area than other humidifiers providing more efficient humidification;
(h) It has an outer shell that expands when hydrated and contracts when desiccated, providing an unmistakable indication of remaining water content;
(i) It can be placed inside an acoustic instrument such as a guitar, and, in the case of an acoustic guitar, does not need to be removed in order to play the instrument;
(j) It does not need to be attached to the instrument;
(k) It can alternatively be placed inside an instrument case or other enclosure.

CONCLUSIONS, RAMIFICATIONS, AND SCOPE

Accordingly, the reader will see that the humidifier in various embodiments can be used to effectively supplement the humidity of wooden instruments, can be left inside the body of a hollow body instrument without affecting playability, and can easily be refilled as necessary. Furthermore, the humidifier has the following additional advantages in that:

It permits the production of humidifiers in various shapes, colors and patterns, to suit a variety of instruments, without the need to change tooling;
It is simple and cost effective to manufacture, comprising of just two components;
It has a large capacity for water, allowing it to supplement humidity for extended periods between refills;
It has a flexible, non-marring outer shell;
It provides an unmistakable indication of its current state of hydration.

Although the description above contains many specifications, these should not be construed as limiting the scope of the embodiments, but merely providing illustrations of some of the several embodiments.

Thus, the scope of the embodiments should be determined by the appended claims and their legal equivalents, rather than by the examples given.

I claim:

1. A humidifier for a musical instrument comprising:
A container, housing an absorbent material;
wherein said container is fabricated from a nonpermeable material in such a way such that it is permeable to the ingress and egress of water in liquid and vapor form;
wherein, said absorbent may be a plurality of absorbent material;
whereby liquid water entering said container is absorbed by said absorbent;
whereby water is desorbed from said absorbent by means of evaporation;
whereby the absorption of water in said absorbent causes said container to expand;
whereby the desorption of water from said absorbent causes said container to contract;
whereby the expansion and contraction of said container provides an immediate and unmistakable indicium of the state of hydration of said humidifier.

2. The humidifier of claim 1 wherein said container is fabricated from a woven sleeve.

3. The humidifier of claim 1 wherein said humidifier is flexible enough to conform to different shapes.

4. The humidifier of claim 1 wherein said container is fabricated from a non-marring material.

5. The humidifier of claim 1 wherein said absorbent is an anionic polymer.

6. The humidifier of claim 1 wherein said absorbent has a defined relative humidity equilibration point.

7. The humidifier of claim 1 wherein said humidifier can be placed inside a hollow bodied musical instrument via the sound hole of said instrument.

8. The humidifier of claim 7 wherein said instrument can be played without removing said humidifier.

9. The humidifier of claim 1 wherein said humidifier can be placed inside another container, such as an instrument case, thereby allowing the humidification of a musical instrument also inside said case.

10. The humidifier of claim 1 wherein said container does not need to be opened in order to hydrate said absorbent.

11. The humidifier of claim 1 whereby a means is provided of attaching said humidifier to the strings of a stringed musical instrument.

12. The humidifier of claim 1 whereby a means is provided of temporarily fastening the ends of said humidifier together, thereby allowing the humidified to be secured around another object.

13. The humidifier of claim 1 whereby a means is provided for retrieving said humidifier from the body cavity of a hollow bodied instrument via the sound hole of said instrument.

14. The humidifier of claim 13 wherein, in the case of 'C', 'D' and 'F' hole instruments, part of said retrieval means cannot enter the body cavity of said instrument.

* * * * *